US006709301B2

(12) United States Patent
Lee

(10) Patent No.: US 6,709,301 B2
(45) Date of Patent: Mar. 23, 2004

(54) CLASPER FOR A SIGNAL CONNECTOR

(76) Inventor: Chun Te Lee, No. 98-1, Lane Chin She Beei., Twen Chu Taichung (TW)

( * ) Notice: Subject to any disclaimer, the term of this patent is extended or adjusted under 35 U.S.C. 154(b) by 36 days.

(21) Appl. No.: 10/179,211

(22) Filed: Jun. 26, 2002

(65) Prior Publication Data

US 2004/0002268 A1 Jan. 1, 2004

(51) Int. Cl.[7] ..... H01R 13/11
(52) U.S. Cl. ..... 439/857
(58) Field of Search ..... 439/851, 856, 439/857, 861

(56) References Cited

U.S. PATENT DOCUMENTS 2,689,337 A * 9/1954 Burtt et al. ..... 439/851
3,083,351 A * 3/1963 Nielsen, Jr. ..... 439/851
4,031,614 A * 6/1977 Gipe ..... 29/879
4,272,149 A * 6/1981 Gallusser et al. ..... 439/851
4,359,258 A * 11/1982 Palecek et al. ..... 439/741
4,550,972 A * 11/1985 Romak ..... 439/839
5,067,916 A * 11/1991 Denlinger et al. ..... 439/857
5,620,347 A * 4/1997 Sawada ..... 439/851
5,775,960 A * 7/1998 Saito et al. ..... 439/843

* cited by examiner

*Primary Examiner*—Tulsidas Patel
(74) *Attorney, Agent, or Firm*—Troxell Law Office PLLC

(57) ABSTRACT

A clasper for a signal connector includes a connecting plate and two clasping heads connected to two ends of the connecting plate. Each clasping head has two clasping pieces with their center portions bending and contacting with each other, and a wide mouth formed in their end portion. The wide mouth has a trumpet-shaped recessed mouth in an inside for guiding a guide needle of a male connector to be inserted through therein with only a little resistance given by the mouth. Then the guide needle may lower damage received by the inner galvanized surfaces of the clasping pieces. The two clasping pieces have a round hole formed in a center straight portion and connected to the trumpet recessed mouth for the guide needle guided and sliding in the round hole to completely fit in the round hole for acquiring superior quality for transmitted signals.

3 Claims, 3 Drawing Sheets

CLASPER FOR A SIGNAL CONNECTOR

BACKGROUND OF THE INVENTION

This invention relates to a clasper for a signal connector, particularly to one easily to be inserted by a guide needle of a male connector, with complete contact of the guide needle with an inner round hole of the clasper so as to transmit signals with high quality.

A conventional connector for coaxial cables disclosed in an U.S. Pat. No. 4,232,931 includes a clasp head consisting of two clasping pieces connected to a connect plate and extending for a certain length and then crossing with each other to form a clamping portion. The clamping portion is very simple, formed by means of mechanical pressing process, having no structure for receiving a guide needle of a male connector, resulting in breaking or scrubbing off a copper or a rubber galvanized inner surface of the clasper. Then the quality of transmitted signals is worsened or missed, and noise signals may easily mix in. In addition, there may happen swaying of the guide needle if the guide needle is not completely fitted in the clasper, producing disqualified signals to be received.

SUMMARY OF THE INVENTION

The first purpose of the invention is to offer a clasper for a signal connector having at least one connecting head consisting of two clasping pieces having an inner center portion contacting with each other. The two clasping pieces have a trumpet-shaped recessed mouth formed to extend and expand outward gradually from an outer end of the contacting center portion so that a guide needle of an male connector may be guided and inserted therein with only a little force owing to a comparatively little resistance of the trumpet-shaped recessed mouth, and accordingly may lower damage to galvanized metal surfaces of the clasping pieces.

The second purpose of the invention is to offer a clasper for a signal connector having the two clasping pieces formed with a round hole made up by a semicircular groove respectively formed in each clasping piece. Then the round hole is connected to the trumpet-shaped recessed mouth for the guide needle to insert and remain therein so as to clasp completely the guide needle of the male connector for ensuring superior quality of transmitted signals.

BRIEF DESCRIPTION OF DRAWINGS

This invention will be better understood by referring the accompanied drawings, wherein.

DETAILED DESCRIPTION OF THE PREFERRED EMBODIMENT

Figure 1:
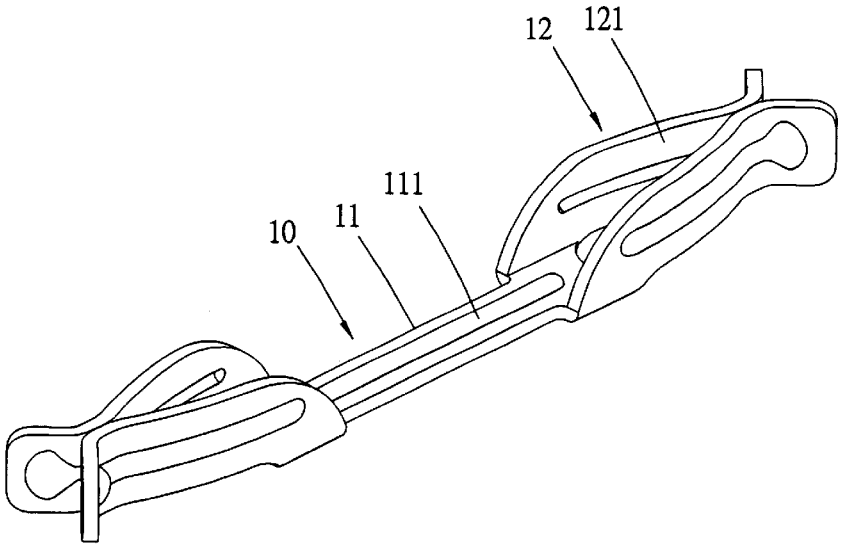
FIG. 1 is a perspective view of a clasper for a signal connector in the present invention.

A preferred embodiment of a clasper for a signal connector in the present invention, as shown in FIG. 1, includes a connecting plate 11 and two clasping heads 12 formed integral.

The connecting plate 11 is horizontal and flat, having a lengthwise projecting rib 111 in the center portion.

Each clasping head 12 is connected respectively to one of two ends of the connecting plate 11, formed integral with the connecting plate 11 and having two clasping pieces 121.

Figure 2:
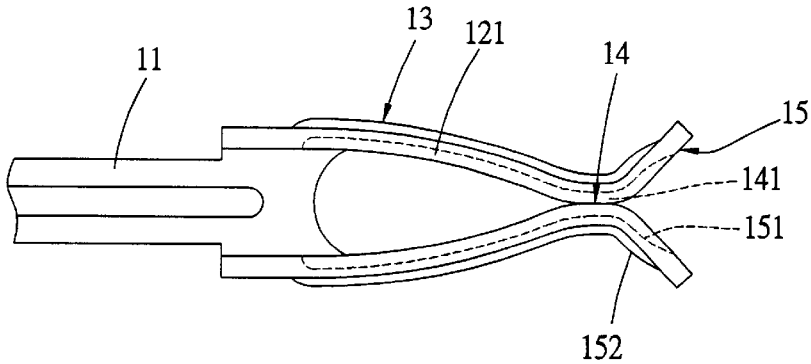
FIG. 2 is an upper view of the clasper for a signal connector in the present invention.

As shown in FIG. 2, the two clasping pieces 121 respectively extends forward from two ends of the connecting plate 11 and curves gradually inward for a certain distance to form an arm member 13. Then the two clasping pieces 121 contact with each other to form a straight clasping section 14 abutting the arm member 13, and further extend and expand gradually forward to form a wide mouth 15.

Figure 3:
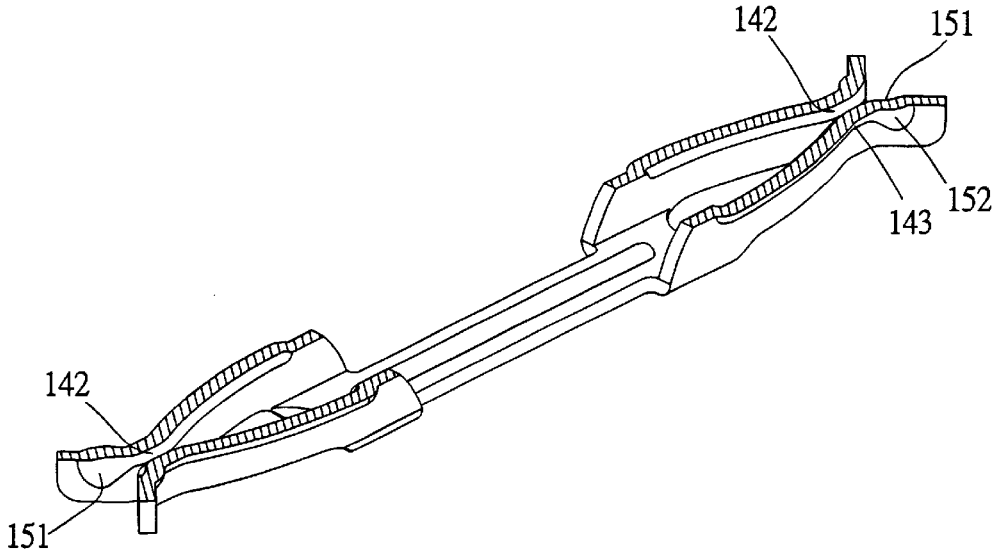
FIG. 3 is a partial cross-sectional view of the clasper for a signal connector in the present invention.
Figure 4:
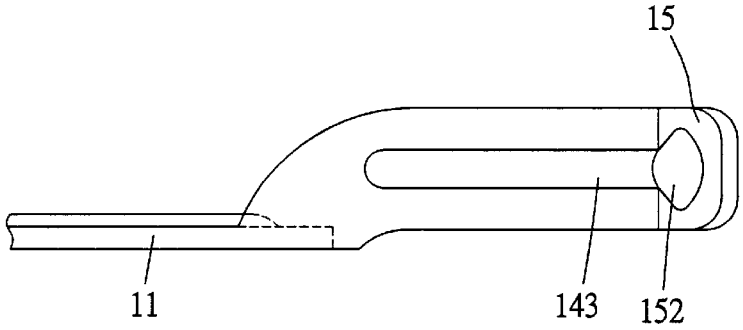
FIG. 4 is a front view of the clasper for a signal connector in the present invention.
Figure 5:
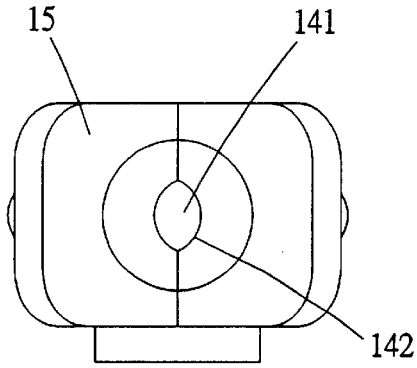
FIG. 5 is a side view of the clasper for a signal connector in the present invention; and, FIG. 6 is a cross-sectional view of the clasper for a signal connector in a used condition in the present invention.
Figure 6:
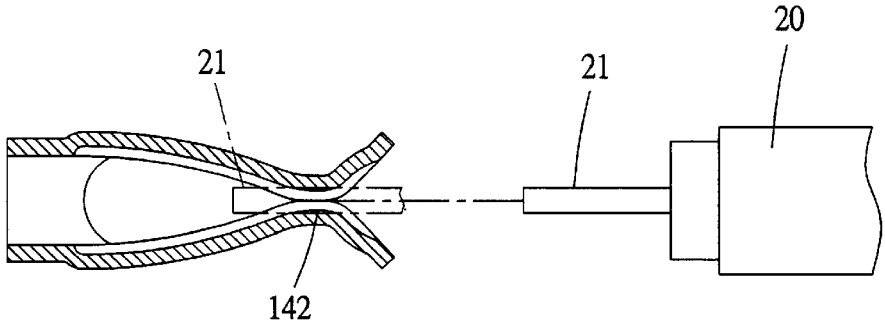

Next, as shown in FIGS. 3, 4 and 5. The straight clasping sections 14 of the two clasping pieces 121 respectively have a semicircular guide groove 141 to make up a round hole 142 for a guide needle 21 of a male connector 20 to fit therein and completely contact with each other, as shown in FIG. 6.

The round hole 12 is located just at the center of the contact line of the inner surfaces of the two clasping pieces 121, and then a trumpet-shaped recess 151 of the wide mouth 15 extends outward from the round hole 12 to reaches an intermediate section of the wide mouth 15 for guiding the guide needle 21 of the male connector 20 to insert in the round hole 12.

Further, as shown in FIG. 3, the two clasping pieces 121 respectively have a lengthwise projecting rib 143 on an outer surface at a corresponding location of the round hole 12, and a trumpet-shaped projection 152 also on the outer surface at a corresponding location to the trumpet-shape recessed mouth 151 for reinforcing the two clasping pieces 121.

Then relative action of the components will be described as follows.

The main feature of the invention is the two clasping pieces 121 formed with the trumpet-shape recessed mouth 151, which extends continually forward from the outer end of the round hole 142. Therefore, when the guide needle 21 of the male connector 20 is inserted inward, the guide needle 21 firstly contacts the trumpet-shape recessed mouth 151 and received by the curved surface of the recessed mouth 151 and then slides in the round hole 142 to remain therein.

If there is not designed with the trumpet-shape recessed mouth 151 in the expanded mouth 15, the guide needle 21 may directly contact the inner surfaces of the two clasping pieces 121. Then the guide needle 21 has to be pushed inward through the two clasping pieces 121 with a comparatively large force for expanding the clasping pieces 21 so the copper or tin galvanized inner surfaces of the two clasping pieces 21 may be broken more or less. The recessed dimensions of the recessed mouth 151 is just the diameter of the guide needle 21, enabling the contacting portions of the clasping pieces 21 with the guide needle 21 expanded outward with only a comparatively small dimensions and with only a little resistance. Then the guide needle 21 can be pushed in with only a light force with help of the curved surfaces of the recessed mouth 151 to reach the round hole 142, completely inserted therein with little possibility of breaking the galvanized metal surfaces of the clasping pieces 121.

In addition, the guide needle 21 is guided to slide and remain in the round hole 142 in the center of the trumpet-shaped recessed mouth 151 owing to the round hole 142 connected to the trumpet-shaped recessed mouth 151. Therefore, the guide needle 21 may not incline to any side in moving in the round hole 142, guided by the trumpet-shaped recessed mouth 151, able to keep the superior quality of signal transmitting.

Moreover, the outer surface of the guide needle 21 may closely contact with the semicircular grooves 141 of the straight section 14 of the two clasping pieces 121, with the arch-shaped arm members 13 having fine elastic force, and the guide needle 21 may completely fit in the round hole 142.

While the preferred embodiment of the present invention has been described above, it will be recognized and understood that various modifications may be made therein and the appended claims are intended to cover all such modifications that may fall within the spirit and scope of the invention.

I claim:

1. A clasper for a signal connector comprising a connecting plate and at least one clasping head all made of a conductive metal, said connecting plate being horizontal and flat, said clasping head connected to one end of said connecting plate and having two clasping pieces, said two clasping pieces respectively having an outer end expanding gradually forward to an upper and a lower side to form a wide mouth:

said two clasping pieces having a center portion of an inner surface contacting with each other, a trumpet-shaped recessed mouth formed in said wide mouth and extending forward from said center portion and expanding gradually forward for a guide needle of a male connector to be guided and inserted therein:

said two clasping pieces having said center contacting portions formed straight for a certain length, a semicircular groove formed respectively in said straight contacting portion of each said clasping piece, said two semicircular grooves making up a round hole, said round hole having its outer end connected to said trumpet-shaped recessed mouth.

2. The clasper for a signal connector as claimed in claim 1, wherein said two clasping pieces further have respectively a projecting rib formed on an outer surface in the corresponding location of said round hole, and a trumpet-shaped projection formed on the outer surface in the corresponding location of said trumpet-shaped recessed hole for reinforcing said two clasping pieces.

3. The clasper for a signal connector as claimed in claim 1, wherein said trumpet-shaped recessed mouth has its largest diameter portion reaching an intermediate portion of said wide mouth of said two clasping pieces.

* * * * *